US010168001B2

(12) United States Patent
Karlsson

(10) Patent No.: US 10,168,001 B2
(45) Date of Patent: Jan. 1, 2019

(54) METHOD AND ARRANGEMENT FOR WASTE COLD RECOVERY IN A GAS-FUELED SEA-GOING VESSEL

(71) Applicant: WARTSILA FINLAND OY, Vaasa (FI)

(72) Inventor: Soren Karlsson, Solf (FI)

(73) Assignee: WARTSILA FINLAND OY, Vaasa (FI)

( * ) Notice: Subject to any disclaimer, the term of this patent is extended or adjusted under 35 U.S.C. 154(b) by 161 days.

(21) Appl. No.: 15/036,024

(22) PCT Filed: Nov. 11, 2013

(86) PCT No.: PCT/FI2013/051062

§ 371 (c)(1),
(2) Date: May 11, 2016

(87) PCT Pub. No.: WO2015/067841

PCT Pub. Date: May 14, 2015

(65) Prior Publication Data

US 2016/0281932 A1 Sep. 29, 2016

(51) Int. Cl.
*F17C 9/04* (2006.01)
*F02M 37/00* (2006.01)

(52) U.S. Cl.
CPC ..... *F17C 9/04* (2013.01); *F02M 37/007* (2013.01); *F02M 37/0017* (2013.01); *F02M 37/0082* (2013.01); *B63B 2770/00* (2013.01); *F17C 2203/03* (2013.01); *F17C 2203/0391* (2013.01); *F17C 2205/0111* (2013.01); *F17C 2205/0323* (2013.01); *F17C 2205/0326* (2013.01);

(Continued)

(58) Field of Classification Search
CPC ..... F17C 9/04; F17C 2223/033; F17C 2205/0323; F17C 2223/0153; F17C 2227/0323; F17C 2260/042; F17C 2250/0636; F17C 2250/0491; F17C 2250/0439; F17C 2227/0379; F17C 2250/043; F17C 2227/0327; F17C 2227/0316; F17C 2223/046; F17C 2223/0161; F17C 2223/041; F17C 2223/035; F17C 2221/033; F17C 2205/0355; F17C 2205/0326; F17C 2205/0111; F17C 2203/0391; F17C 2227/0107; F17C 2227/0309; F17C 2227/0332; F17C 2227/0372; F17C 2227/0374; F17C 2250/032; F17C 2250/00; F17C 2265/066; F17C 2270/0105; F17C 2223/03; F02M 37/0017; F02M 37/007; F02M 37/0082; B63B 2770/00
See application file for complete search history.

(56) References Cited

U.S. PATENT DOCUMENTS 2,903,860 A 9/1959 Brown
8,043,136 B2 10/2011 Sipilä et al.

*Primary Examiner* — Ana Vazquez
(74) *Attorney, Agent, or Firm* — Muncy, Geissler, Olds & Lowe, P.C.

(57) ABSTRACT

A fuel storage and distribution system for a gas-fueled sea-going vessel includes a tank room that constitutes a gastight space enclosing tank connections and valves associated with them. A part of a refrigeration or air conditioning circuit reaches into the tank room. A first local heat transfer circuit is configured to receive heat from the part of the refrigeration or air conditioning circuit in the tank room and arranged to transfer such received heat to liquefied gas fuel handled in the fuel storage and distribution system.

9 Claims, 9 Drawing Sheets

(52) U.S. Cl.
CPC ..... *F17C 2205/0355* (2013.01); *F17C 2221/033* (2013.01); *F17C 2223/0153* (2013.01); *F17C 2223/0161* (2013.01); *F17C 2223/033* (2013.01); *F17C 2223/035* (2013.01); *F17C 2223/041* (2013.01); *F17C 2223/046* (2013.01); *F17C 2227/0107* (2013.01); *F17C 2227/0309* (2013.01); *F17C 2227/0316* (2013.01); *F17C 2227/0323* (2013.01); *F17C 2227/0327* (2013.01); *F17C 2227/0332* (2013.01); *F17C 2227/0372* (2013.01); *F17C 2227/0374* (2013.01); *F17C 2227/0379* (2013.01); *F17C 2250/032* (2013.01); *F17C 2250/043* (2013.01); *F17C 2250/0408* (2013.01); *F17C 2250/0439* (2013.01); *F17C 2250/0491* (2013.01); *F17C 2250/0631* (2013.01); *F17C 2250/0636* (2013.01); *F17C 2260/011* (2013.01); *F17C 2260/042* (2013.01); *F17C 2265/066* (2013.01); *F17C 2270/0105* (2013.01)

METHOD AND ARRANGEMENT FOR WASTE COLD RECOVERY IN A GAS-FUELED SEA-GOING VESSEL

TECHNICAL FIELD

The invention concerns in general the technology of arranging the heat and material flows in and in association with the fuel storage and distribution system of a gas-fuelled sea-going vessel. Especially the invention concerns utilizing the fuel storage and distribution system to absorb heat from the HVAC (heating, ventilation, and air conditioning) system of the vessel.

BACKGROUND OF THE INVENTION

In US patent publication 2903860 is disclosed a fuel storage and distribution system for a gas-fuelled sea-going vessel, comprising a gas tank for storing gas fuel, a major portion of which is in liquefied form; a tank room that constitutes a gastight space enclosing tank connections to and from the tank room and valves associated with them; a part of a refrigeration or air conditioning circuit reaching into said tank room, a first local heat transfer circuit in the tank room, which first local heat transfer circuit is configured to receive heat from said part of the refrigeration or air conditioning circuit in said tank room. In the US patent publication 2903860 is also disclosed a method for transferring heat from a heating, ventilation, and air conditioning system of a gas-fuelled sea-going vessel to gas fuel of said vessel, comprising transferring heat from a refrigeration or air conditioning circuit, which reaches into a tank room, to a first local heat transfer circuit in said tank room, and using said first local heat transfer circuit to heat liquefied gas fuel handled in said fuel storage and distribution system.

Natural gas, or in general mixtures of hydrocarbons that are volatile enough to make the mixture appear in gaseous form in room temperature, constitutes an advantageous alternative to fuel oil as the fuel of internal combustion engines. In sea-going vessels that use natural gas as fuel, the natural gas is typically stored onboard in liquid form, giving rise to the commonly used acronym LNG (Liquefied Natural Gas). Natural gas can be kept in liquid form by maintaining its temperature below a boiling point, which is approximately −162 degrees centigrade (−260 degrees Fahrenheit). Natural gas can be also stored for use as fuel by keeping it compressed to a sufficiently high pressure, in which case the acronym CNG (Compressed Natural Gas) is used. This description refers mainly to LNG because liquefying is considered more economical than compressing at the time of writing this text.

FIG. 1 illustrates schematically the architecture of a known system onboard an LNG-fuelled vessel. An LNG bunkering station 101 is located on the deck and used to fill up the system with LNG. The LNG fuel storage system comprises one or more thermally insulated gas tanks 102 for storing the LNG in liquid form, and the so-called tank room 103 where the LNG is controllably evaporated and its distribution to the engine(s) is arranged. Evaporation means a phase change from liquid to gaseous phase, for which reason all subsequent stages should leave the L for liquefied out of the acronym and use only NG (Natural Gas) instead.

The engine 104 or engines of the vessel are located in an engine room 105. Each engine has its respective engine-specific fuel input subsystem 106, which in the case of gaseous fuel is in some sources referred to as the GVU (Gas Valve Unit). The tank room 103 of FIG. 1 comprises two evaporators, of which the first evaporator 107 is the so-called PBU (Pressure Build-Up) evaporator used to maintain a sufficient pressure inside the gas tank 102. Hydrostatic pressure at the inlet of a main supply line 108 inside the gas tank 102 is the driving force that makes the LNG flow into the second evaporator 109, which is the MGE or Main Gas Evaporator from which the fuel is distributed in gaseous form towards the engines. In order to ensure that evaporated gas flows to the GVU(s) and further to the engine(s) at sufficiently high pressure, the PBU system maintains the internal pressure of the gas tank 102 at or close to a predetermined value, which is typically between 5 and 10 bars.

The engine 104 comprises one or more cooling circuits. Schematically shown in FIG. 1 is an external loop 110 of the so-called low temperature (LT) cooling circuit, which may be used for example to cool lubricating oil. The so-called LT water that circulates in the external loop 110 may have a temperature around 50 degrees centigrade when it goes through a heat exchanger 111, in which it donates heat to a mixture of glycol and water that in turn transfers heat to the evaporators 107 and 109. The glycol/water mixture circuit comprises a circulation pump 112 and an expansion tank 113. Glycol is needed in the mixture to prevent it from freezing when it comes into contact with the extremely cold LNG inlet parts of the evaporators 107 and 109.

Many types of sea-going vessels, in particular passenger cruisers, use considerable amounts of energy in various cooling functions, for example to provide air conditioning and to refrigerate food supplies. A prior art document U.S. Pat. No. 8,043,136 suggests using the gas fuel evaporation system to absorb heat from the HVAC system of the vessel. FIG. 2 is a schematic illustration of the heat flows and control functions as taught by FIG. 2 of said prior art document. The core of the prior art system is a heat transfer circuit 201, which absorbs heat from the HVAC system 202 according to arrow 203. The heat transfer circuit 201 donates heat to the gas fuel in a gas fuel evaporation arrangement 204, which in said prior art document is a heat exchanger and/or evaporator through which the gas fuel flows. A control entity 205 monitors the sufficiency of the heat transfer from the HVAC system 202 and augments it, if necessary, by extracting additional heat from sea water 206 according to arrow 207. Another control entity 208 is implemented as a part of the HVAC system 202, so that if not enough cooling takes place by donating heat to the heat transfer circuit 201, electrically driven cooling arrangements can be used to dump heat to the environment 209 according to arrow 210.

Prior art arrangements leave room for improvement in the overall energy efficiency of handling the heat flows on board a gas-fuelled sea-going vessel. Additionally they often include relatively complicated structures and a number of relatively expensive equipment. For example the system of U.S. Pat. No. 8,043,136 requires a pump to circulate the fluid in the heat transfer circuit and another pump to circulate the heat transfer medium in the HVAC circuit, and a total of at least four different heat exchangers. Maritime classification requirements typically require doubling the pumps to achieve reliability through redundancy, which doubles all pump-related costs. Complicated structures mean longer construction times at the shipyard.

SUMMARY OF THE INVENTION

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

According to an aspect of a present invention there is provided a fuel storage and distribution system for a sea-going vessel, which enables cutting manufacturing costs and constructional complexity in comparison to prior art systems. According to another aspect of a present invention there is provided a fuel storage and distribution system that enables using cold gas fuel effectively to absorb heat from an HVAC system of the vessel. According to a further aspect of the invention there is provided a fuel storage and distribution system that enables flexibly controlling the heat flows between the HVAC and engine cooling systems of the vessel and the gas fuel. According to yet another aspect of the invention there is provided a method for transferring heat from the HVAC system of the vessel to gas fuel of said vessel in an efficient and flexible manner.

Advantageous objectives of the invention are achieved by using a local heat transfer circuit in the tank room to transfer heat from a part of a refrigeration or air conditioning circuit reaching into the tank room to the cold gas fuel.

A fuel storage and distribution system according to the invention is characterised by the features recited in the characterizing part of the independent claim directed to such a system.

A method for transferring heat from an HVAC system of a gas-fuelled sea-going vessel to gas fuel of said vessel according to the invention is characterised by the features recited in the characterizing part of the independent claim directed to such a method.

Advantageous embodiments of the invention are described in the depending claims.

The invention makes it possible to eliminate a number of the pumps and other components of prior art systems by making a part of a refrigeration or air conditioning circuit reach into the tank room. A local heat transfer circuit in the tank room may extract heat from said part of a refrigeration or air conditioning circuit and donate such heat further to the gas fuel either directly or indirectly. Significant portions of the fuel storage and distribution system can be constructed as a module that is delivered to the shipyard as a completed entity, which cuts construction times and simplifies work arrangements in building the ship.

The exemplary embodiments of the invention presented in this patent application are not to be interpreted to pose limitations to the applicability of the appended claims. The verb "to comprise" is used in this patent application as an open limitation that does not exclude the existence of also unrecited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF EMBODIMENTS OF THE INVENTION

Figure 1:
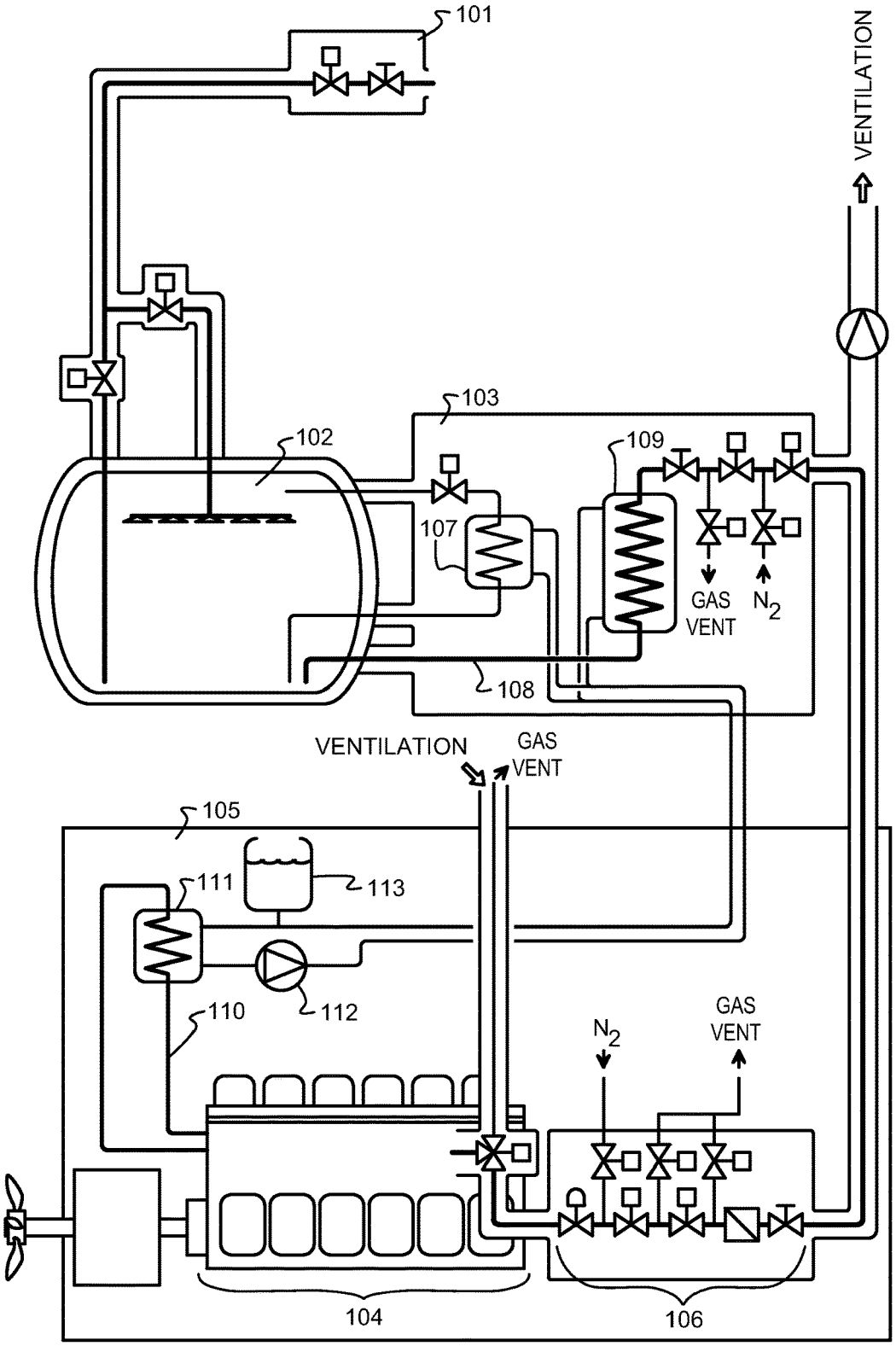
Fig. 1 PRIOR ART
FIG. 1 illustrates a prior art LNG fuel distribution architecture.
Figure 2:
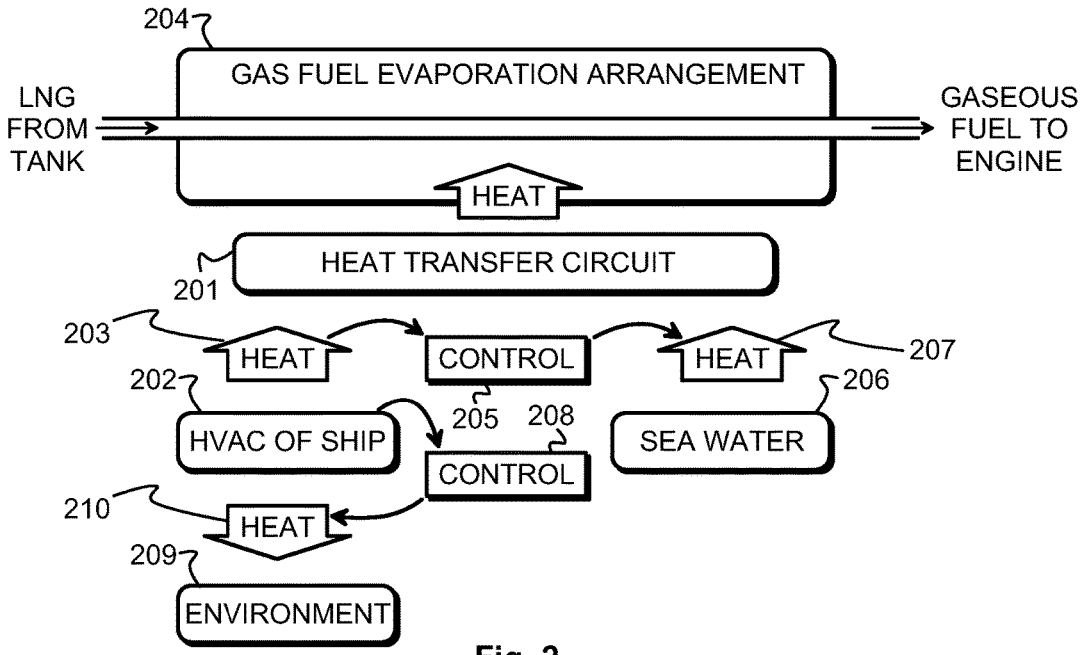
Fig. 2 PRIOR ART
FIG. 2 illustrates heat and material flows in a prior art solution.
Figure 3:
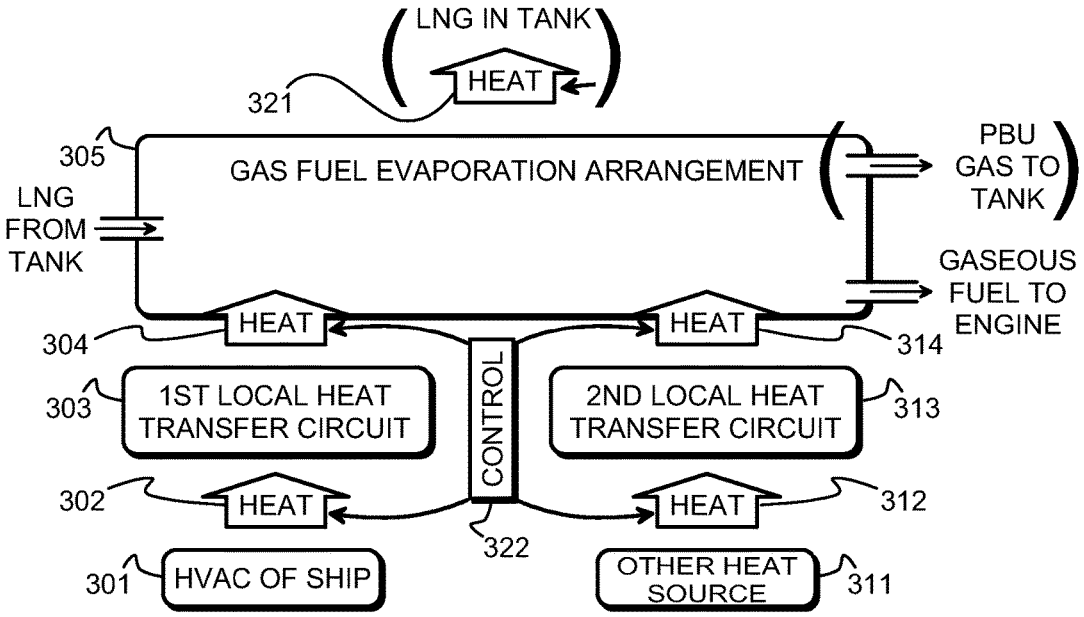
FIG. 3 illustrates heat and material flows in a fuel storage and distribution system according to an embodiment of the invention.

FIG. 3 illustrates some material and heat flows in a fuel storage and distribution system according to an embodiment of the invention. Block 301 represents generally HVAC systems, or systems that are used on board the vessel to produce and maintain temperatures that are below ambient temperature. Examples of what the HVAC system block 301 may comprise are air conditioning of cabins, lounges, restaurants, and other internal spaces; refrigeration of cold stores and other storage rooms; refrigeration of cargo holds or individual containers; and cooling of potable water.

Arrow 302 shows how heat is transferred from the HVAC systems to a heat transfer circuit, which is called the first local heat transfer circuit 303. Arrow 304 shows how the first local heat transfer circuit 303 is arranged to transfer such received heat to liquefied gas fuel that is handled in the fuel storage and distribution system. Conceptually the last-mentioned transfer takes place within a gas fuel evaporation arrangement 305, although not all transfer of heat from the first local heat transfer circuit 303 needs to immediately cause evaporation of any gas fuel.

The right side of FIG. 3 shows how another heat source 311 in the vessel also produces heat, at least some of which is transferred according to arrow 312 to a second local heat transfer circuit 313. Arrow 314 shows how the second local heat transfer circuit 313 is arranged to transfer such received heat to the liquefied gas fuel within the gas fuel evaporation arrangement 305. The other heat source 311 may be for example an engine that comprises a cooling circuit. A part of the engine cooling circuit may reach into the tank room, where it donates heat to the second local heat transfer circuit 313 according to arrow 312.

According to the laws of thermodynamics the spontaneous flow of thermal energy always takes place from the hotter entity to the colder entity; only heat flows, not cold. However in practice it is common to say that a certain amount of cold is constantly needed in the HVAC system 301, and an ample amount of cold is available in the cold, liquefied gas fuel. Cold that otherwise would be "removed" from the gas fuel through dedicated generation and use of energy would be "waste cold", and the act of arranging the heat flows so that such cold can be used to absorb thermal energy that otherwise would be dumped to the environment may be called waste cold recovery. Conceptually, if not thermodynamically, it can be thought that some of the cold flows from the gas fuel into the HVAC system where it is consumed, in a flow direction opposite to that illustrated by arrows 302 and 304.

One output from the gas fuel evaporation arrangement 305 is gaseous (i.e. evaporated) fuel to the gas-fuelled engine of the vessel. Two other possible outputs may be alternatives of each other, which is illustrated by placing them in parentheses in FIG. 3. The gas fuel evaporation arrangement 305 may output heat that is used to heat gas fuel that is still in storage in the gas tank, according to arrow 321. Such heating would aim at maintaining a sufficient pressure inside the gas tank, by heating stored gas fuel in the gaseous phase and/or evaporating stored gas fuel in the liquid phase. The other alternative, which is shown in the upper right part of FIG. 3, is that some evaporated gas fuel output from the gas fuel evaporation arrangement 305 is circulated back into the gas tank for pressure build-up (PBU) purposes. The alternatives shown in parentheses in FIG. 3 are not mutually exclusive although typically one of them is selected by the most important mechanism for maintaining gas tank pressure.

FIG. 3 illustrates how a common control entity 322 can be used to control all illustrated heat flows (including that of arrow 321; the control line shown is truncated to preserve graphical clarity). The control entity 322 typically comprises a processor, and it may have a number of pressure and temperature sensors at its disposal, so that it can monitor the pressures and temperatures at various locations and make intelligent decisions that maintain the measured pressures and temperatures at desired ranges. Many of the control functions may be implemented in practice in the form of controllable valves that increase and decrease the flows of fluid heat transfer media in the corresponding circuits, as well as the flows of the gas fuel through various parts of the gas fuel evaporation arrangement 305.

Figure 4:
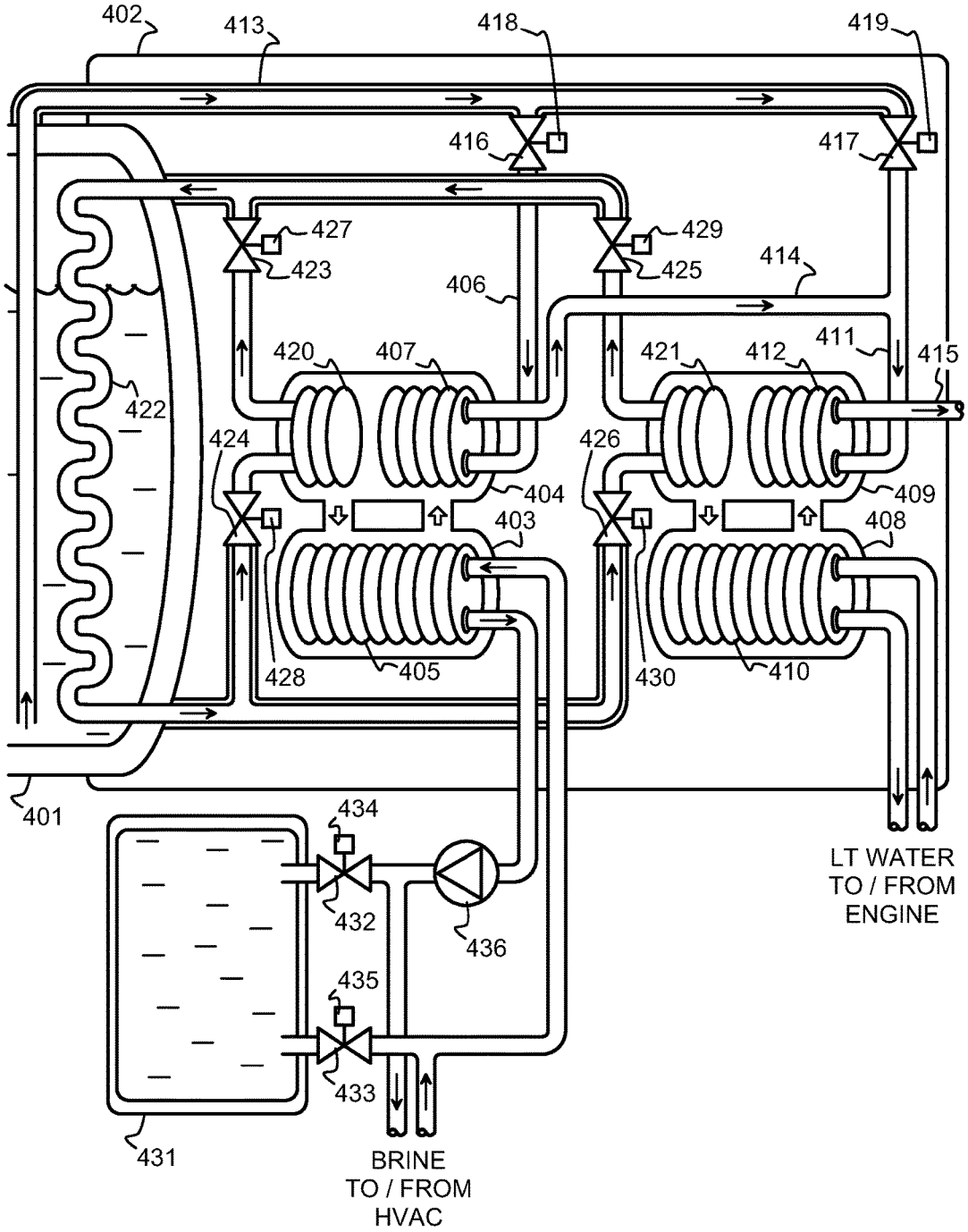
FIG. 4 illustrates an exemplary implementation of parts of a fuel storage and distribution system according to an embodiment of the invention.

FIG. 4 illustrates parts of a fuel storage and distribution system according to an embodiment of the invention. On the left is a gas tank 401 for storing gas fuel, a major portion of which is in liquefied form. Associated with the gas tank 401 is a tank room 402, which constitutes a gastight space enclosing tank connections and valves associated with them. Some pipe connections to and/or from the gas tank 401 may come directly into the tank room 402, but there may also be pipe connections that traverse some free space there between. For consistency all pipe connections to and from the gas tank 401 have been schematically illustrated as double-walled, although no double walls may be needed for connections that come directly into the tank room 402. The way in which the outer barrier of a double-walled pipe is built and connected to e.g. the double wall structure of the gas tank 401 is not important to the present invention.

The lower left part of FIG. 4 illustrates a part of a refrigeration or air conditioning circuit that reaches into the tank room 402. The fluid medium that flows in said refrigeration or air conditioning circuit is any fluid medium to which heat is transferred from some cooled part that in a wide sense can be said to be comprised in the HVAC system of the vessel. The exemplary designation brine is used for said fluid medium in FIG. 4.

A first local heat transfer circuit is configured to receive heat from said part of the refrigeration or air conditioning circuit in the tank room 402, and arranged to transfer such received heat to liquefied gas fuel handled in the fuel storage and distribution system. In particular, the first local heat transfer circuit comprises a first local heat transfer re-boiler 403 and a first local heat transfer condenser 404, between which the circulation of some evaporable fluid transfer medium take place. The part of the refrigeration or air conditioning circuit constitutes a hot element 405 within the first local heat transfer re-boiler 403. The fuel storage and distribution system comprises a pipe 406 configured to lead gas fuel through a cold element 407 within the first local heat transfer condenser 404.

The references to "hot" and "cold" indicate the purpose of the respective element, and do not necessarily conform to what a human observer would consider hot or cold. A hot element within a re-boiler or an evaporator is that part that during use is meant to donate heat to the transfer medium, causing it to evaporate. A cold element within a condenser is that part that during use is meant to receive heat from the transfer medium, causing it to condense.

The fuel storage and distribution system of FIG. 4 is designed so that also heat from another source can be used to evaporate and/or heat up gas fuel destined to the gas-fuelled engine of the vessel. A part of the engine cooling circuit reaches into the tank room, as shown in the lower right part of FIG. 4. A second local heat transfer circuit is configured to receive heat from said part of the engine cooling circuit in said tank room 402 and arranged to transfer such received heat to liquefied gas fuel handled in the fuel storage and distribution system. In particular, the second local heat transfer circuit comprises a second local heat transfer re-boiler 408 and a second local heat transfer condenser 409. Said part of the engine cooling circuit constitutes a hot element 410 within the second local heat transfer re-boiler 408. The fuel storage and distribution system comprises a pipe 411 configured to lead gas fuel through a cold element 412 within said second local heat transfer condenser 409.

LNG may flow out of the gas tank 401 through a feed pipe 413. In the embodiment of FIG. 4 the feed pipe branches into a first branch that leads to the cold element 407 in the first local heat transfer condenser 404, and into a second branch that leads to the cold element 412 in the second local heat transfer condenser 409. A connecting pipe 414 leads from the cold element 407 in the first local heat transfer condenser 404 to a T-fitting in said second branch, so that gas fuel that came through the cold element 407 in the first local heat transfer condenser 404 also flows through the cold element 412 in the second local heat transfer condenser 409. The T-fitting could also be in the outlet pipe 415, so that gas fuel that came through the cold element 407 in the first local heat transfer condenser 404 would not flow through the cold element 412 in the second local heat transfer condenser 409. As yet another alternative, a valve arrangement could be provided for determining, whether gas fuel that came through the cold element 407 in the first local heat transfer condenser 404 should also flow through the cold element 412 in the second local heat transfer condenser 409 or not.

Controllable valves 416 and 417 operated through the respective actuators 418 and 419 control the amount of gas fuel flowing from the feed pipe 413 into the first and second branches respectively. In other words, the controllable valves 416 and 417 act as selection valves for selectively leading gas fuel either through the cold elements 407 and 412 in the first and second local heat transfer condensers 404 and 409 in sequence, or through only one of said cold elements 407 or 412.

The fuel storage and distribution system of FIG. 4 comprises also a pressure build-up (PBU) circuit for building up and maintaining sufficient internal pressure inside the gas tank 401. A part of the PBU circuit constitutes a cold element in at least one of the first local heat transfer condenser 404 or the second local heat transfer condenser 409. In particular, in the embodiment of FIG. 4, there are both: a first PBU cold element 420 is located in the first local heat transfer condenser 404, and a second PBU cold element 421 is located in the second local heat transfer condenser 409. The PBU circuit is a closed loop configured to lead fluid heating medium through at least one of said PBU cold elements 420 or 421 and a heating element 422 located inside the gas tank 401 adjacent to the tank room 402. Controllable valves 423, 424, 425, and 426 operated through the respective actuators 427, 428, 429, and 430 control the relative amount of fluid heating medium that flows through the two PBU cold elements 420 and 421.

The exemplary designation brine used above underlines the fact that in the embodiment of FIG. 4 the part of a refrigeration or air conditioning circuit that reaches into the tank room 402 is a part of a circulation loop for liquid heat transfer medium, i.e. for heat transfer medium that is not meant to change phase anywhere within its circulation loop. At different times there may be different amounts of heat that need to be transferred out of the HVAC system of the vessel; for example, when a passenger cruiser is at port with no or only few passengers on board, the cooling requirements in the air conditioning system may be smaller than with everyone on board.

In order to balance the differing needs for heat transfer at different times it may be advisable to include a buffer storage in said refrigeration or air conditioning circuit. For this purpose the fuel storage and distribution system of FIG. 4 comprises a thermally insulated buffer tank 431 for temporarily storing an amount of said liquid heat transfer medium. Controllable valves 432 and 433, operated through the respective actuators 434 and 435, are provided for controlling a flow of said liquid heat transfer medium in to and out of the buffer tank 431. A circulation pump 436 ensures sufficient circulation of the liquid heat transfer medium in the refrigeration or air conditioning circuit. Maritime classification requirements may require providing two parallel circulation pumps for redundancy.

A method for transferring heat from a heating, ventilation, and air conditioning (HVAC) system of a gas-fuelled seagoing vessel to gas fuel of the vessel using the system of FIG. 4 comprises transferring heat from the refrigeration or air conditioning circuit, which reaches into the 402 tank room, to a first local heat transfer circuit in said tank room. In particular, the liquid heat transfer medium donates heat to a surrounding evaporable transfer medium inside the first local heat transfer re-boiler 403. The first local heat transfer circuit is used to heat liquefied gas fuel handled in said fuel storage and distribution system. In particular, gas fuel destined to combustion in the engine is heated directly in the cold element 407 within the first local heat transfer condenser 404. Additionally gas fuel inside the gas tank 401 is heated indirectly by heating the fluid heating medium in the PBU cold element 420 within the first local heat transfer condenser 404. Said fluid heating medium in turn heats the gas fuel inside the gas tank when it flows through the heating element 422.

Said method may further comprise transferring heat from an engine cooling circuit, which reaches into the tank room 402, to a second local heat transfer circuit in the tank room 402. The second local heat transfer circuit is then used to heat gas fuel handled in said fuel storage and distribution system. In particular, direct heating of gas fuel destined to the engine takes place in the cold element 412 within the second local heat transfer condenser 409, and indirect heating of the stored gas fuel takes place through the PBU circuit in the same way as described above.

The method may further comprise temporarily storing an amount of liquid heat transfer medium that flows in said refrigeration or air conditioning circuit in the thermally insulated buffer tank 431, and controllably retrieving liquid heat transfer medium from said buffer tank 431 back into the refrigeration or air conditioning circuit.

Figure 5:
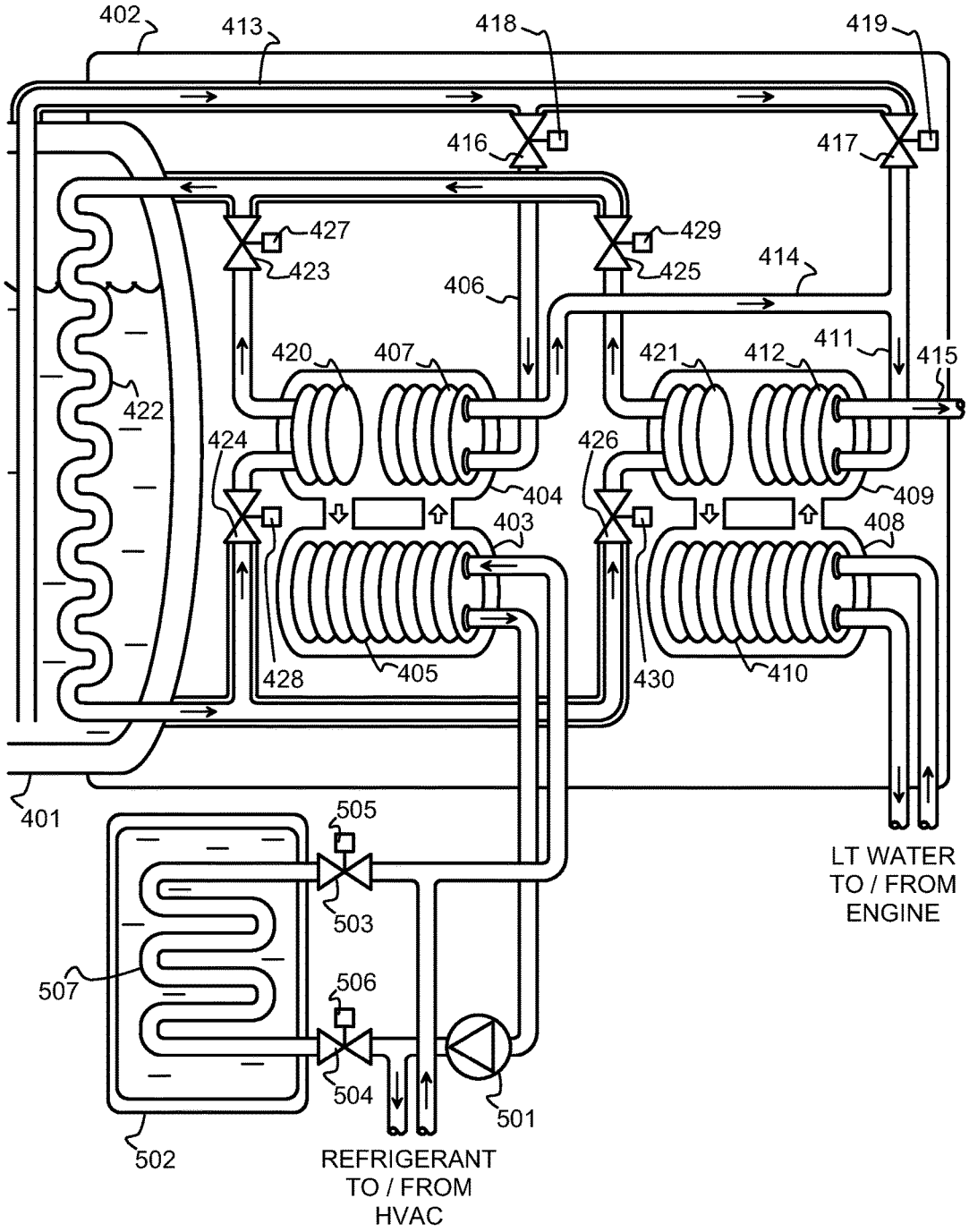
FIG. 5 illustrates an exemplary implementation of parts of a fuel storage and distribution system according to another embodiment of the invention.

FIG. 5 illustrates a fuel storage and distribution system according to another embodiment of the invention. Parts that have similar function as in the embodiment of FIG. 4 have the same reference designators. The most important difference compared to the embodiment of FIG. 4 is that in FIG. 5, the part of a refrigeration or air conditioning circuit that reaches into the tank room 402 is a part of a circulation loop for evaporable refrigerant, and not for liquid heat transfer medium (brine) as in FIG. 4. In FIG. 5 we assume that the act of absorbing heat from the HVAC system comprises evaporating some of the evaporable refrigerant, which then flows in vapor form from below into the system shown in FIG. 5. The vapor-phased refrigerant condenses inside the hot element 405 within the first local heat transfer re-boiler, donating heat to the transfer medium circulating in the local heat transfer circuit. Condensed evaporable refrigerant returns to the HVAC system. Condensed refrigerant may place different requirements to the pump than brine, for which reason the circulation pump 501 has a different reference designator in FIG. 5.

Although it would be basically possible to temporarily store condensed evaporable refrigerant in a thermally insulated buffer tank, FIG. 5 discloses an alternative solution for thermal energy buffering. The system comprises a thermal accumulator 502, and controllable valves 503 and 504, operated through the respective actuators 505 and 506, for controlling the flow of the evaporable refrigerant through the thermal accumulator 502. The thermal accumulator 502 may be for example a thermally insulated tank containing brine or other liquid with relatively high specific heat capacity, and the system may comprise a heat exchanger 507 inside said thermally insulated tank, through which heat exchanger the condensed evaporable refrigerant may flow. On its way through the heat exchanger the condensed evaporable refrigerant either extracts heat from the brine or donates heat to it, depending on their mutual temperature difference. The same can be described in the common casual parlance of waste cold recovery by saying that the condensed evaporable refrigerant either donates cold to the brine or extracts cold from it, depending on their mutual temperature difference.

A method of operation of the embodiment of FIG. 5 differs from that of the embodiment of FIG. 4 in that it comprises controllably circulating evaporable refrigerant that flows in the refrigeration or air conditioning circuit through a thermal accumulator for storing heat in said thermal accumulator or retrieving heat from said thermal accumulator according to need.

Figure 6:
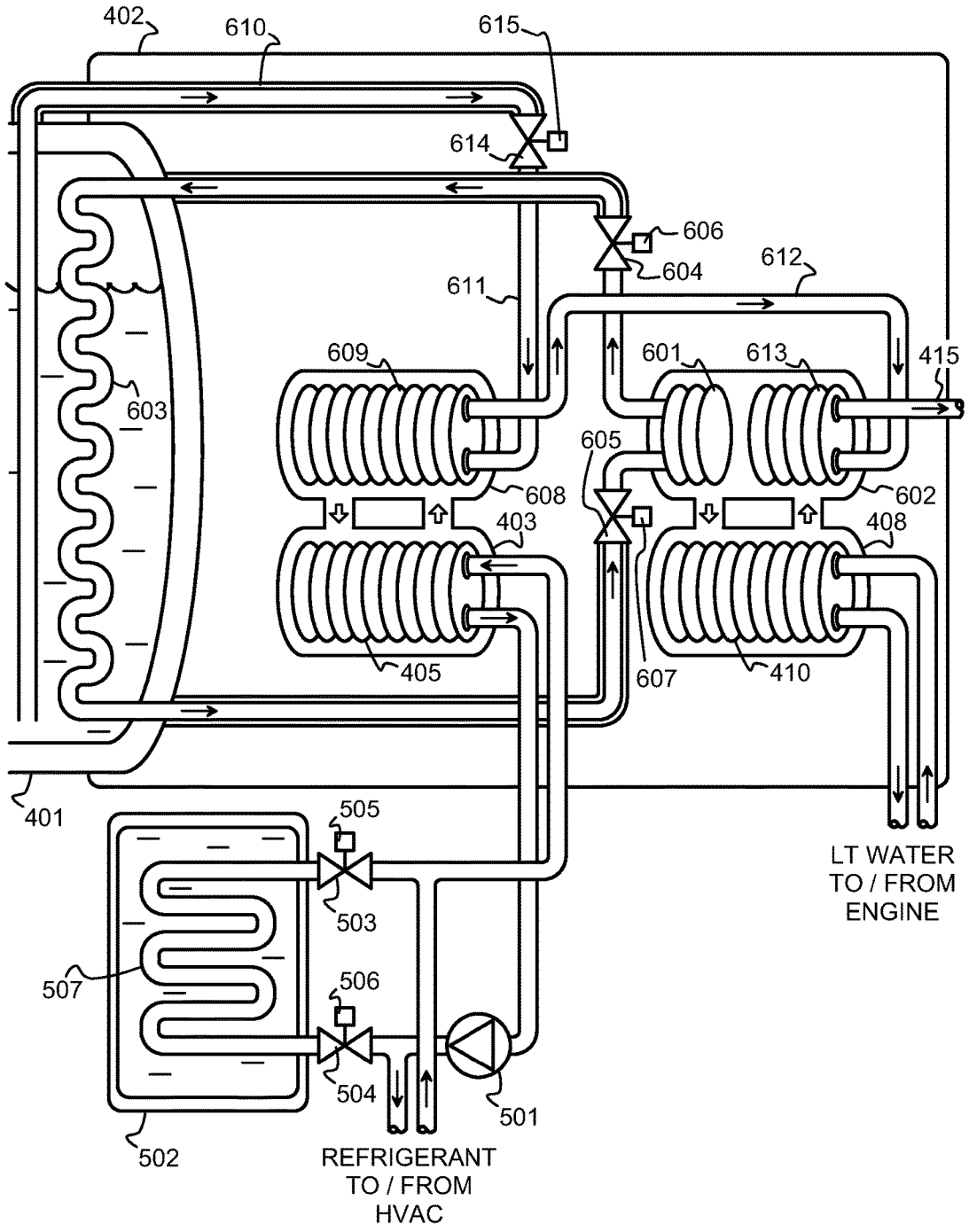
FIG. 6 illustrates an exemplary implementation of parts of a fuel storage and distribution system according to another embodiment of the invention.

FIG. 6 illustrates a fuel storage and distribution system according to another embodiment of the invention. Parts that have similar function as in the embodiments of FIG. 4 and/or FIG. 5 have the same reference designators. The variation illustrated by FIG. 6 is by no means bound to any of the previously mentioned alternatives of liquid heat transfer medium (FIG. 4) or evaporable refrigerant (FIG. 5). The last-mentioned is shown in FIG. 6 as an example, but the refrigeration or air conditioning circuit could quite as well resemble that shown in FIG. 4.

The variation that FIG. 6 means to particularly illustrate is related to the structure and arrangement of the PBU circuit and the main gas evaporation circuit. Although there are still two local heat transfer circuits within the tank room 402, only one of them has a role in pressure build-up of the gas tank. A part of the PBU circuit constitutes a PBU cold element 601 in the second heat transfer condenser 602. The PBU circuit is a closed loop configured to lead fluid heating medium through said PBU cold element 601 in the second local heat transfer condenser 602 and a heating element 603 located inside the gas tank 401 adjacent to the tank room 402. Controllable valves 604 and 605 operated through the respective actuators 606 and 607 control the rate at which the fluid heating medium flows to and from the PBU cold element 601.

The first local heat transfer condenser 608 comprises only one cold element 609, which is the cold element through which flows the gas fuel destined to combustion in the engine of the vessel. From the feed pipe 610 there is only one branch 611, which leads to the inlet of the cold element 609 within the first local heat transfer condenser 608. Thus all gas fuel destined to combustion in the engine flows through the cold element 609 within the first local heat transfer condenser 608, and further through the connection pipe 612 and through the cold element 613 in the second local heat transfer condenser 602. The valve 614, operated through the corresponding actuator 615, acts as the general cut-off valve in the feed pipe 610.

Figure 7:
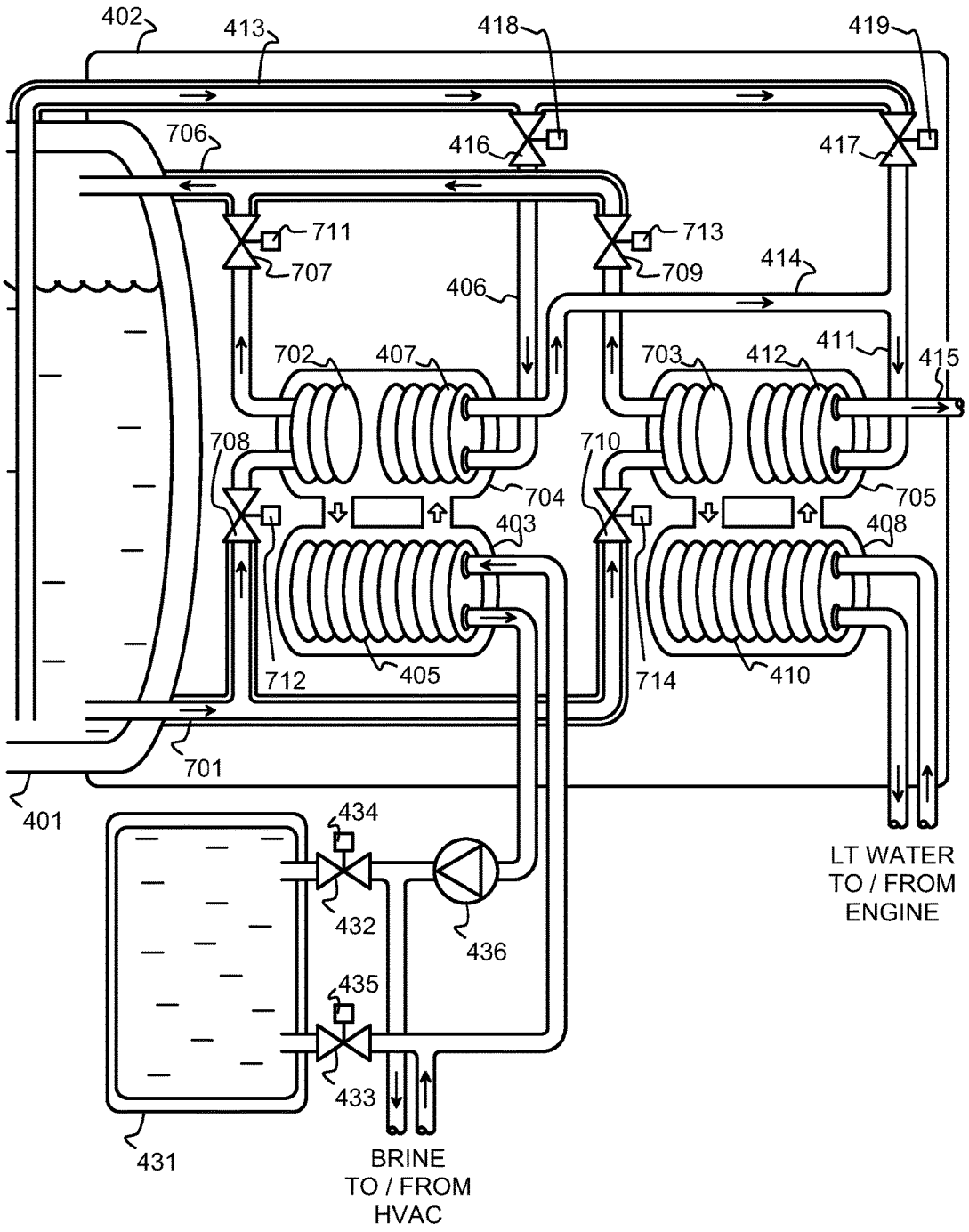
FIG. 7 illustrates an exemplary implementation of parts of a fuel storage and distribution system according to another embodiment of the invention.

FIG. 7 illustrates a fuel storage and distribution system according to another embodiment of the invention. Parts that have similar function as in the embodiments of the previous drawings have the same reference designators. The variation illustrated by FIG. 7 is by no means bound to any of the previously mentioned alternatives of liquid heat transfer medium (FIG. 4) or evaporable refrigerant (FIG. 5). The first-mentioned is shown in FIG. 7 as an example, but the refrigeration or air conditioning circuit could quite as well resemble that shown in FIG. 5. The variation illustrated in FIG. 7 is also by no means bound to any of the previously mentioned alternatives concerning the structure of the PBU circuit and the main gas evaporation circuit. The approach concerning these resembles that of FIGS. 4 and 5, but the simpler structures illustrated in FIG. 6 could be used quite as well.

The variation that FIG. 7 means to particularly illustrate is related to where and how the heating of the gas fuel in the PBU circuit is actually implemented. The PBU circuit of FIG. 7 is an open loop configured to lead gas fuel from the gas tank 401 adjacent to the tank room 402 to a PBU cold element in at least one of the first or second local heat transfer condenser, and back to the gas tank. In particular, in the embodiment of FIG. 7 gas fuel in liquid phase flows from the gas tank 401 through a PBU feed pipe 701 and its appropriate branches to the PBU cold elements 702 and 703 in the first and second local heat transfer condensers 704 and 705 respectively, where it vaporizes. Gas fuel in gaseous phase thus flows from the PBU cold elements 702 and 703 back to the gas tank 401 through a PBU return pipe 706. Controllable valves 707, 708, 709, and 710 operated through the respective actuators 711, 712, 713, and 714 control the relative amount of gas fuel that flows through the two PBU cold elements 702 and 703 and vaporizes on its way.

Figure 8:
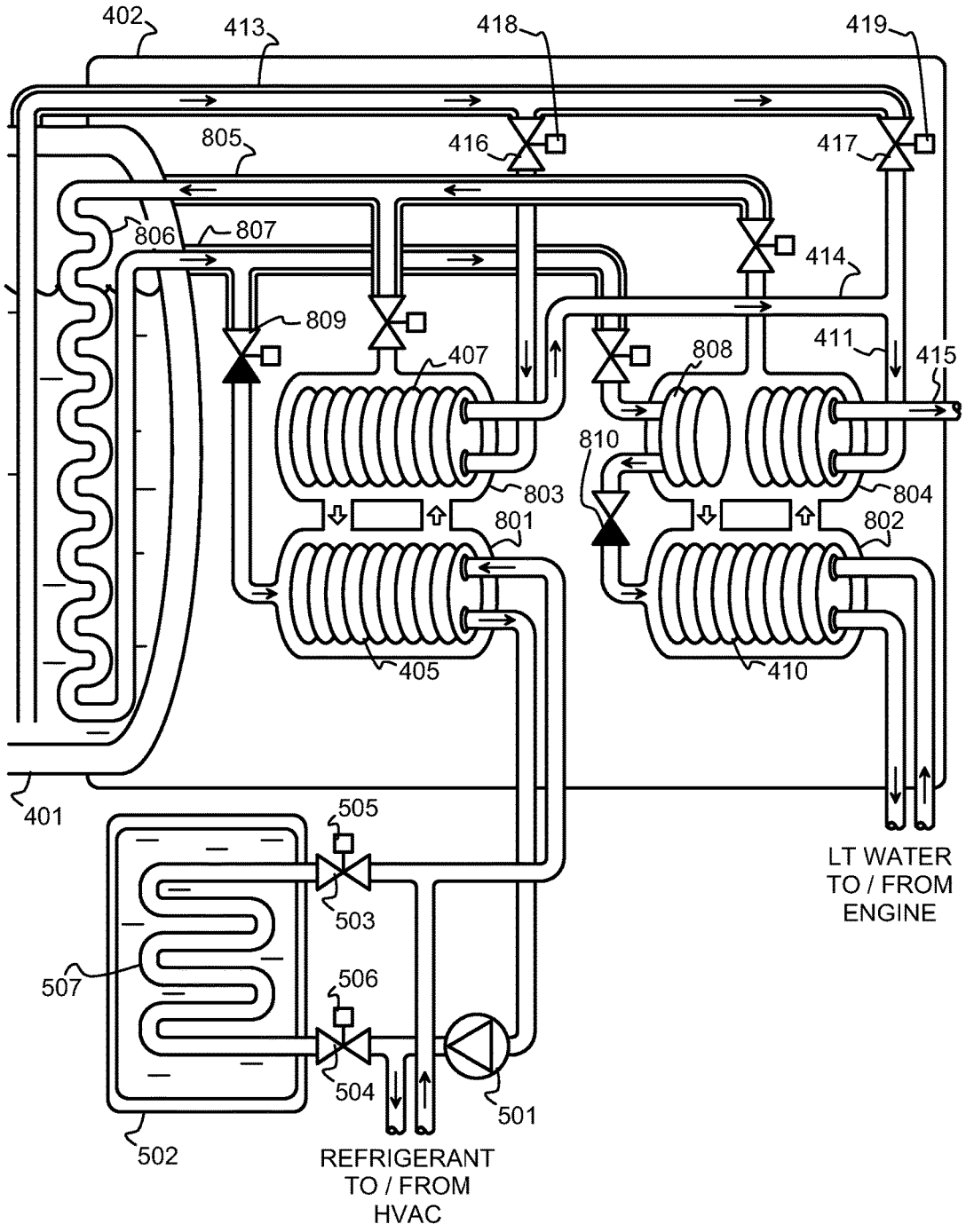
FIG. 8 illustrates an exemplary implementation of parts of a fuel storage and distribution system according to another embodiment of the invention.

FIG. 8 illustrates a fuel storage and distribution system according to another embodiment of the invention. Parts that have similar function as in the embodiments of the previous drawings have the same reference designators. The variation illustrated by FIG. 8 is by no means bound to any of the previously mentioned alternatives of liquid heat transfer medium (FIG. 4) or evaporable refrigerant (FIG. 5). The last-mentioned is shown in FIG. 8 as an example, but the refrigeration or air conditioning circuit could quite as well resemble that shown in FIG. 4. The variation illustrated in FIG. 8 is also by no means bound to using both local heat transfer circuits for pressure build-up, or to a particular structure of the main gas evaporation circuit. Only one local heat transfer circuit could be used for PBU, and/or the simpler main gas evaporation circuit as in FIG. 6 could be used quite as well.

The variation that FIG. 8 means to particularly illustrate is related to how the circulation of heat transfer medium in a closed-loop PBU circuit is actually implemented. Additionally the embodiment of FIG. 8 points out how using a closed-loop PBU circuit allows placing all lead-throughs in the topmost part of the gas tank, so that even a mechanical failure of a pipeline would not easily cause any extremely cold liquid gas to flood out of the gas tank.

In the embodiment of FIG. 8 some of the evaporable heat transfer medium that flows in vapor form from each local heat transfer re-boiler 801 or 802 to the corresponding local heat transfer condenser 803 or 804 may continue into heating the gas fuel inside the gas tank. From each local heat transfer condenser 803 and 804 there is a valve-controlled connection to a PBU forward pipe 805 that leads into a heating element 806 inside the gas tank 401. A PBU return pipe 807 leads fluid heating medium flowing in the PBU circuit out of the heating element 806.

The returning fluid heating medium may flow either directly to the corresponding local heat transfer re-boiler, as in the case of the first local heat transfer re-boiler 801, or it may flow first to a cold element in the local heat transfer condenser for preheating and only thereafter to the corresponding local heat transfer re-boiler. The latter alternative is implemented in the second local heat transfer circuit in FIG. 8, where the PBU cold element 808 acts as a preheater. It is advisable to use a preheater of this kind if the medium that flows in the hot element of the local heat transfer re-boiler has a freezing point at or above those temperatures that the fluid heating medium in the PBU circuit may have when it returns from the heating element inside the gas tank. Check valves 808 and 809 or corresponding devices allowing only unidirectional flow may be used to keep fluid heating medium in the PBU circuit from flowing into wrong direction.

Figure 9:
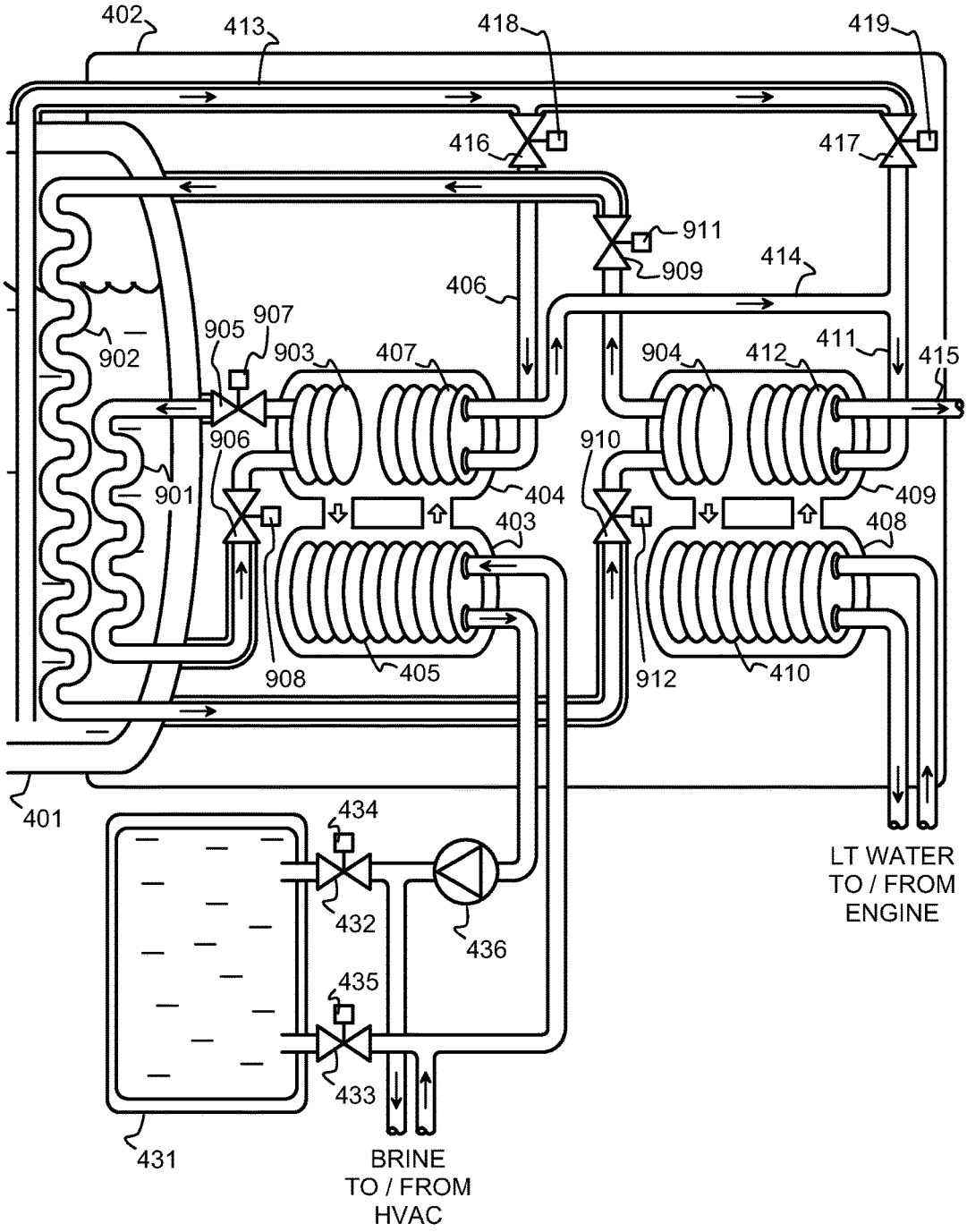
FIG. 9 illustrates an exemplary implementation of parts of a fuel storage and distribution system according to another embodiment of the invention.

FIG. 9 illustrates a fuel storage and distribution system according to another embodiment of the invention. Parts that have similar function as in the embodiments of the previous drawings have the same reference designators. The variation illustrated by FIG. 9 is by no means bound to any of the previously mentioned alternatives of liquid heat transfer medium (FIG. 4) or evaporable refrigerant (FIG. 5). The first-mentioned is shown in FIG. 9 as an example, but the refrigeration or air conditioning circuit could quite as well resemble that shown in FIG. 5. The variation illustrated by FIG. 9 is also by no means bound to a particular form of the main gas evaporation circuit, but for example the approach illustrated in FIG. 6 could be used.

The variation that FIG. 9 means to particularly illustrate is related to the number of separate PBU circuits and/or heating elements inside the gas tank. The embodiment of FIG. 9 comprises two heating elements 901 and 902 inside the gas tank 401. Correspondingly there are two separate PBU circuits, so that the fluid heating medium that flows through the first heating element 901 comes to the PBU cold element 903 within the first local heat transfer condenser 404 for reheating. The fluid heating medium that flows through the second heating element 902 comes to the PBU cold element 904 within the second local heat transfer condenser 409 for reheating. Controllable valves 905 and 906 operated through actuators 907 and 908 respectively control the flow of fluid heating medium in the first PBU circuit, and controllable valves 909 and 910 operated through actuators 911 and 912 respectively control the flow of fluid heating medium in the second PBU circuit.

Figure 10:
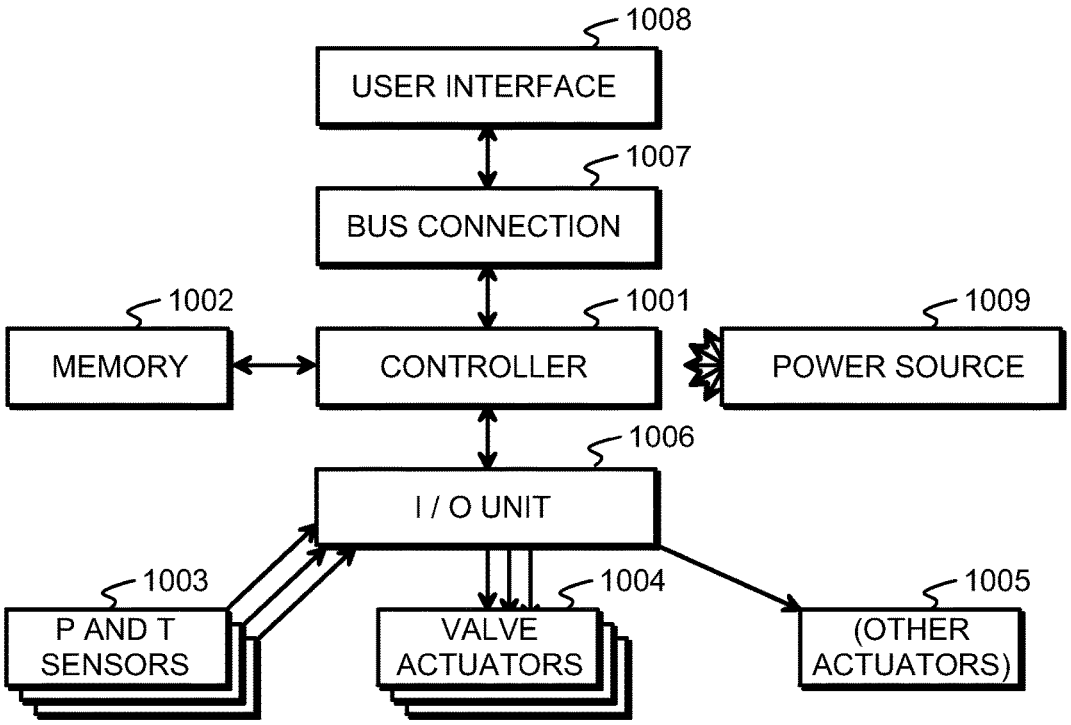
FIG. 10 illustrates schematically a control architecture of a fuel storage and distribution system according to an embodiment of the invention.

FIG. 10 illustrates schematically an arrangement for controlling the fuel storage and distribution system. The central element in such controlling is a controller 1001, which may be for example a microprocessor. Computer-readable instructions are stored in a non-volatile memory 1002 and, when executed by the controller 1001, cause the implementation of a method according to an embodiment of the invention.

The pressures that prevail at various locations in the fuel storage and distribution system can be measured with a number of suitably located pressure sensors 1003. Typical action to be taken to physically control the pressure would involve opening and/or closing some valves that control the flows of gaseous and liquid media, for which purpose there are a number of appropriately placed actuators 1004. It is also possible that the system comprises other actuators 1005 or controllable devices, for example controllable a pump or a heater that is used to control the temperature of some critical part of the arrangement.

The pressure sensors 1003, the actuators 1004 and the possible other actuators 1005 may be commonly designated as the physical action devices. An input and output unit (I/O unit) 1006 serves as an interface between the controller 1001 and the physical action devices. It exchanges information in digital form with the controller 1001, receives measurement signals in the form of voltages and/or currents from the pressure sensors 1003, and transmits commands in the form of voltages and/or currents to the actuators 1004 and 1005. The input and output unit 1006 also makes the necessary conversions between the digital representations it uses in communicating with the controller 1001 and the (typically, but not necessarily) analog voltage and/or current levels it uses in controlling the physical action devices.

A bus connection 1007 links the controller 1001 with one or more user interfaces 1008, which may be located for example in an engine control room and/or on the bridge of the sea-going vessel. A user interface typically comprises one or more displays and some user input means, such as a touch-sensitive display, a keyboard, a joystick, a roller mouse, or the like. The display part of the user interface is used to display to a human user information about the state and operation of the fuel storage and distribution system. The input means of the user interface are available for the user to give commands that control the operation of the gaseous fuel storage and distribution system.

A power source arrangement 1009 derives and distributes the necessary operating voltages for the various electrically operated parts of the control arrangement.

Evaporation and condensing are very effective ways of transferring heat, if efficiency is evaluated in terms of the space required by the equipment compared to the amount of heat that can be transferred. Also using evaporable transfer medium may help avoiding pumps in the system, because the density difference between liquid and gaseous phase of the transfer medium is large, and consequently gravity can be used as a major driving force that keeps the transfer medium in appropriate motion around the heat transfer circuit. Further, a major portion of the hardware involved may be built within and/or in close association with a module that comprises at least the tank room and possibly also the gas tank(s). As an overall consequence a fuel storage and distribution system according to the invention can provide significant savings in making the construction process of a gas-fuelled sea-going vessel more straightforward.

The possibility of using the HVAC system as an additional heat source for the fuel storage and distribution system means that waste cold can be recycled efficiently, or in other words, waste heat produced in the HVAC system that would otherwise need to be dumped to the environment can be absorbed for a useful purpose in the fuel storage and distribution system. Additionally the use of the HVAC system and the engine in parallel as heat sources enables very flexible control of the heat flows, and takes advantage of the fact that the cooling power (or: heat absorbing capacity) offered by the combined system is a function of the engine power.

Variations and modifications are possible to the embodiments described so far without parting from the scope defined by the appended claims. For example, even if the embodiments described so far have only involved one gas tank for graphical clarity, the same structural principles and functional solutions are easily repeated in arrangements in which two or more gas tanks share the same tank room. The other heat source from which heat is brought to the fuel storage and distribution system does not need to be the LT cooling water circuit of the engine; for example, heat generated by combustion and friction in the propulsion system can be brought in many ways, directly or indirectly, to the fuel storage and distribution system. The other heat source may also comprise parts of e.g. a steam generation circuit and/or a thermal oil circuit on board the sea-going vessel. Various other heat sources can also be used in combinations, for example so that both an engine cooling circuit and a steam generation circuit both comprise a part reaching into the tank room.

The invention claimed is:

1. A fuel storage and distribution system for a gas-fueled sea-going vessel, comprising:

a gas tank for storing gas fuel, a portion of which is in liquefied form, a tank room that constitutes a gastight space enclosing tank connections to and from the tank room and valves associated with the connections, a part of a refrigeration or air conditioning circuit reaching into said tank room, and a first local heat transfer circuit in the tank room, which first local heat transfer circuit is configured to receive heat from said part of the refrigeration or air conditioning circuit in said tank room, wherein in that the fuel storage and distribution system further comprises in its first local heat transfer circuit a first local heat transfer re-boiler and a first local heat transfer condenser, and wherein part of the refrigeration or air conditioning circuit constitutes a hot element within said first local heat transfer re-boiler, and arranged to transfer such received heat to liquefied gas fuel handled in the first local heat transfer re-boiler and the first local heat transfer condenser in said fuel storage and distribution system, a pipe leading gas fuel through a cold element within said first local heat transfer condenser and a part of an engine cooling circuit reaching into said tank room;

a second local heat transfer circuit in the tank room, which second local heat transfer circuit comprises a second local heat transfer re-boiler and a second local heat transfer condenser, wherein part of the engine cooling circuit constitutes a hot element within said second local heat transfer re-boiler, and which second local heat transfer circuit is receiving heat from said part of the engine cooling circuit in said tank room and transferring such received heat to liquefied gas fuel handled in the second local heat transfer re-boiler and the second local heat transfer condenser in said fuel storage and distribution system, a pipe leading gas fuel through a cold element within said second local heat transfer condenser.

2. The fuel storage and distribution system according to claim 1, comprising selection valves for selectively leading gas fuel either through the cold elements in said first and second local heat transfer condensers in sequence, or through only one of said cold elements.

3. The fuel storage and distribution system according to claim 2, comprising a pressure build-up (PBU) circuit, a part of which constitutes a PBU cold element in at least one of said first local heat transfer condenser or said second local heat transfer condenser.

4. The fuel storage and distribution system according to claim 3, wherein said PBU circuit is a closed loop configured to lead fluid heating medium through:

said PBU cold element in at least one of said first local heat transfer condenser or said second local heat transfer condenser, and a heating element located inside the gas tank.

5. The fuel storage and distribution system according to claim 3, wherein said PBU circuit is an open loop configured to lead gas fuel from the gas tank to said PBU cold element in at least one of said first local heat transfer condenser or said second local heat transfer condenser, and back to said gas tank.

6. The fuel storage and distribution system according to claim 1, wherein said part of the refrigeration or air conditioning circuit is a part of a circulation loop for liquid heat transfer medium.

7. The fuel storage and distribution system according to claim 6, comprising:

a thermally insulated buffer tank for temporarily storing an amount of said liquid heat transfer medium, and controllable valves for controlling a flow of said liquid heat transfer medium in to and out of said buffer tank.

8. The fuel storage and distribution system according to claim 1, wherein said part of the refrigeration or air conditioning circuit is a part of a circulation loop for evaporable refrigerant.

9. The fuel storage and distribution system according to claim 8, comprising:

a thermal accumulator and controllable valves for controlling flow of said evaporable refrigerant through said thermal accumulator.

* * * * *